US007431601B2

(12) United States Patent
Nugent, Jr. et al.

(10) Patent No.: US 7,431,601 B2
(45) Date of Patent: Oct. 7, 2008

(54) AUTOMATIC POWER LINE DISCONNECT APPARATUS

(75) Inventors: Thomas H. Nugent, Jr., Port Jefferson Station, NY (US); Ernest A. Kussmaul, 146 Sunset Dr., Sayville, NY (US) 11782

(73) Assignee: Ernest A. Kussmaul, West Sayville, NY (US)

( * ) Notice: Subject to any disclaimer, the term of this patent is extended or adjusted under 35 U.S.C. 154(b) by 0 days.

(21) Appl. No.: 11/640,787

(22) Filed: Dec. 18, 2006

(65) Prior Publication Data

US 2008/0146058 A1 Jun. 19, 2008

(51) Int. Cl.
*H01R 29/00* (2006.01)

(52) U.S. Cl. ..... 439/188; 439/181; 200/51.1

(58) Field of Classification Search ..... 439/188, 439/181; 200/51.1

See application file for complete search history.

(56) References Cited

U.S. PATENT DOCUMENTS 4,911,650 A * 3/1990 Garcia Ramos ..... 439/188
2003/0060069 A1 * 3/2003 Duquerroy et al. ..... 439/188

* cited by examiner

*Primary Examiner*—Tho D Ta
(74) *Attorney, Agent, or Firm*—Charles E. Baxley

(57) ABSTRACT

An automatic power line disconnect apparatus has a sensor pin for signaling the separation of the plug from the disconnect apparatus. The operative movement of the sensor pin is shorter than the length of the male electrical connectors on the apparatus, thereby insuring that the apparatus is disconnected from the power line before the electrical connectors' contact is broken to reduce electrical connector erosion from arcing. A motor driving a rack and pinion gear combination responds to an engine starter signal by driving the rack in a direction that disconnects the power line plug from the automatic disconnect apparatus. Further circuits are provided to lock out low voltage starter signals, photoelectric detectors to control movement of the rack, and timer circuits to limit the duration of the motor operation and to lock out starter signals when the disconnect apparatus is being separated from the power line plug.

9 Claims, 8 Drawing Sheets

AUTOMATIC POWER LINE DISCONNECT APPARATUS

BACKGROUND OF THE INVENTION

Field of the Invention

The present invention relates to automatic power line disconnect apparatuses and, more particularly and preferably to a direct current (DC) motor for driving a rack and pinion gear that separates a power line from the vehicle to which the disconnect apparatus is attached, and the like. Instead of the DC motor, an alternating current motor or a hydraulic system or a pneumatic system could be employed. Yet the DC motor is simplest and easiest to control.

Power line disconnect apparatuses for automatically uncoupling a power line from a vessel or a vehicle, for example, must satisfy several very difficult requirements. Illustratively, fire apparatuses, ambulances and other equipment often need a constant supply of electrical power when parked or otherwise not in use. The vehicle, however, must uncouple swiftly from the power line when it is to be driven away in response to an emergency, or the like.

Consequently, an automatic power line disconnect apparatus must not only eject the mating power line plug on activation of the vehicle's engine, but also it must eject the plug in a manner that reduces or eliminates drawing an arc between the plug's female electrical contacts and the disconnect apparatus' corresponding male electrical contacts. Arcing, if not suppressed, is a major source of wear on both the male contacts in the disconnect apparatus and the mating female contacts in the plug. It is this wear that significantly reduces the service life of the disconnect apparatus.

To overcome these problems and to meet the requirements of a satisfactory automatic power line disconnect apparatus combination solenoid and spring devices have been used with considerable success. As the need for greater parked vehicle input power and connector size has increased, more positive separation force is required than that which can be provided through solenoid and spring devices. Accordingly, there is a need for an apparatus that provides adequate positive disconnect force for these larger devices in a manner that reduces or eliminates the greater arcing that ordinarily would accompany disconnecting electrical connections that carry larger currents or amperages.

BRIEF SUMMARY OF THE INVENTION

These and other disconnect apparatus needs are satisfied to a great extent through the practice of the invention.

For instance, in one embodiment of the invention, in response to activation of a vehicle engine a DC motor turns a pinion gear that meshes with and drives a rack. The rack, in turn, extends to eject the mating plug from the electrical disconnect apparatus. The motor is stopped by a photoelectric detector to prevent rack overshoot and a time control activates the motor to retract and extend the rack, as needed. A sensor pin on the disconnect apparatus disconnects the electrical circuit between the vehicle and the power line by activating a switch as the mating plug is ejected, but before the couplings among the plug and disconnect apparatus electrical contacts are broken, in order to eliminate electrical arcing at the contacts.

Thus, in accordance with the invention, a positive disconnect action is assured with minimum arcing at the contacts. This action is achieved not only with larger and heavier disconnect apparatuses than that which heretofore had been possible but also with apparatus carrying much greater electrical currents.

For a more complete appreciation of the invention, attention is invited to the following detailed description of an embodiment of the invention when taken with the figures of the drawing. The scope of the invention, however, is limited only through the claims appended hereto.

DETAILED DESCRIPTION OF PREFERRED EMBODIMENT OF THE INVENTION

Figure 4:
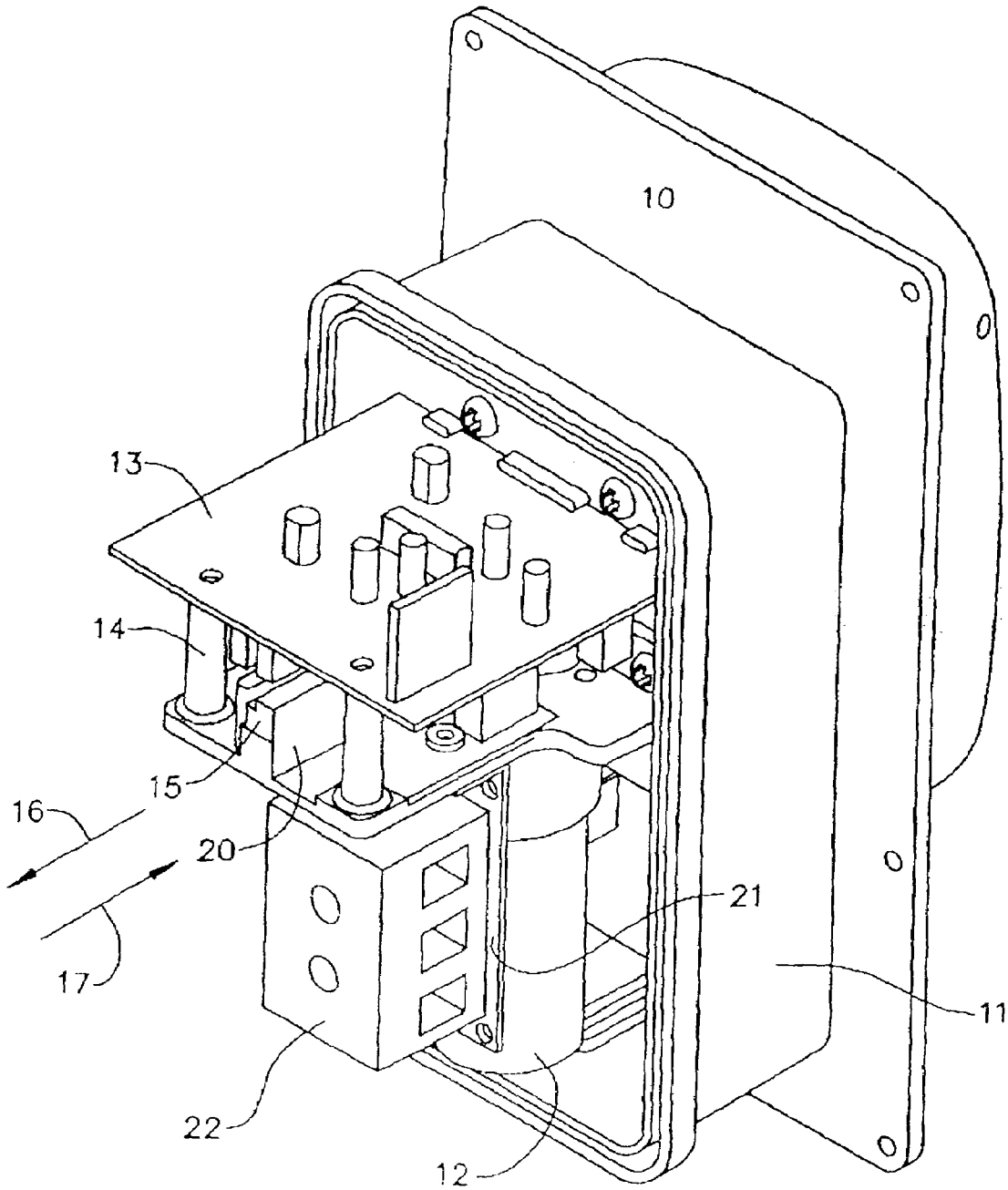
FIG. 4 is a perspective view of a disconnect apparatus with the rear cover removed for use in connection with the circuit shown in FIGS. 1 and 2.

Turning now to FIG. 4, a typical automatic shore or power line disconnect apparatus 10 that embodies salient principles of the invention is illustrated with its rear cover (not shown) removed. A generally rectangular housing 11 encloses a direct current motor 12, and a printed circuit board 13 that is supported on a motor bracket 14. A gear rack 15 is also mounted on the motor bracket 14 for selective sliding movement in the directions of arrows 16, 17. The gear rack 15, moreover, is secured in position relative to the rotor (not shown in FIG. 4) of the direct current motor 12 by means of a gear rack retainer 20 that is attached to the motor bracket 14. Instead of the DC motor an alternating current (AC) motor (not shown or a hydraulic system (not shown) or a pneumatic system (not shown) could be employed. Yet the DC motor is simplest and easiest to control.

A terminal strip bracket 21 is fastened to the motor bracket 14 on a side that is opposite to the side of the bracket 14 that supports the gear rack 15 and the gear rack retainer 20. Accordingly, a three pin connector terminal strip 22 is secured to the bracket 21. A switch or microswitch 23, not shown in FIG. 4 but illustrated in FIG. 5, also is fixed to the terminal strip bracket 21 (FIG. 4) behind the terminal strip 22.

Returning to FIG. 5, the microswitch 23 has a resilient arm 24 one end of which is connected to and selectively activates and deactivates the microswitch 23 in response to movement of a sensor pin 25 in the directions of arrows 26, 27. The sensor pin 25, moreover, bears against free end 30 of the microswitch arm 24. The sensor pin 25 is mounted for movement in the directions of the arrows 26, 27 in a power receptacle 31, which receptacle 31 is partially enclosed in a cone 32. The power receptacle typically would be at 120 volts but other suitable voltages might be used.

Figure 5:
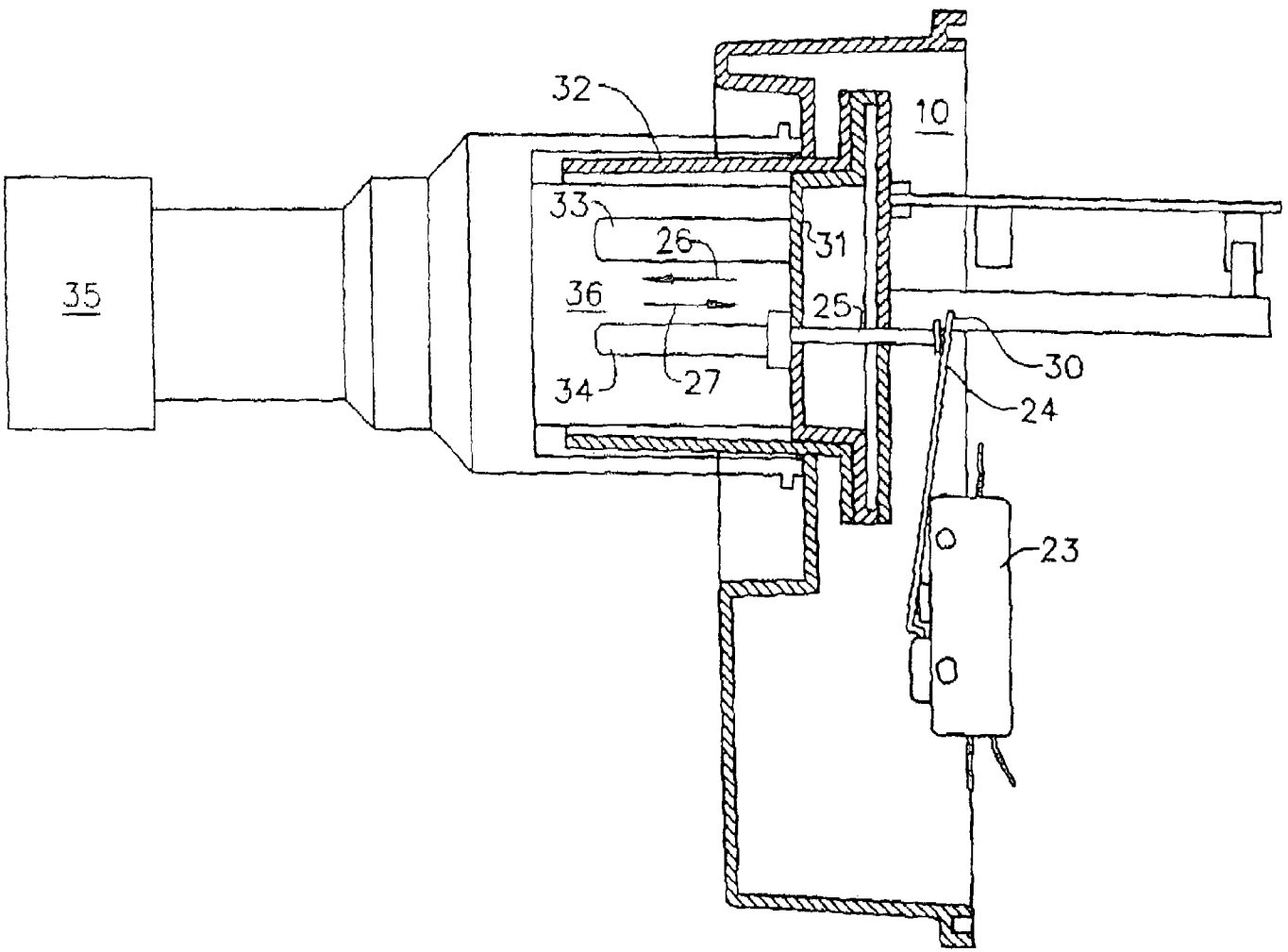
FIG. 5 is a partial assembly drawing in section illustrating features of the invention in one mode of operation.

As illustrated in FIG. 5, three electrical male contacts, of which only contacts 33, 34 are shown in FIG. 5, protrude from the power receptacle 31 toward a plug 35. FIG. 5 shows the male contacts 33, 34 for carrying large amounts of electrical current, e.g. 30 amperes or more, electrically connected to corresponding female contacts (not shown on the drawing). Note particularly that in accordance with a salient feature of the invention that the male electrical contacts 33, 34 are appreciably longer than the corresponding length of the sensor pin 25. The cone 32, again as illustrated in FIG. 5, is telescoped within a portion of the plug 35 to enable the power receptacle to bear against a mating portion 36 in the plug 35. In this way an electrical current flows from the power line (not shown) or the like, through the plug 35 and the automatic disconnect apparatus 10 to the vehicle or vessel (also not shown in the drawing) to which the disconnect apparatus 10 is joined. Thusly, with the configuration of the contacts 33, 34 shown in FIG. 5, with the sensor pin 25 being pressed against a corresponding surface on the mating portion 36 of the plug 35 by the microswitch arm 24, the sensor pin 25 protrudes beyond the power receptacle 31 in the direction of the arrow 27. In this manner the sensor pin 25 presses the free end 30 of the resilient microswitch arm 24 in the same direction to establish the normal operating positions of these components. Accordingly, as shown in FIG. 5, the microswitch 23 is activated to apply power through electrical contacts in the plug 35 and three corresponding contacts (only 33 and 34 being shown in FIG. 5) in the disconnect apparatus 10 to the stationary vehicle or vessel (not shown).

Figure 6:
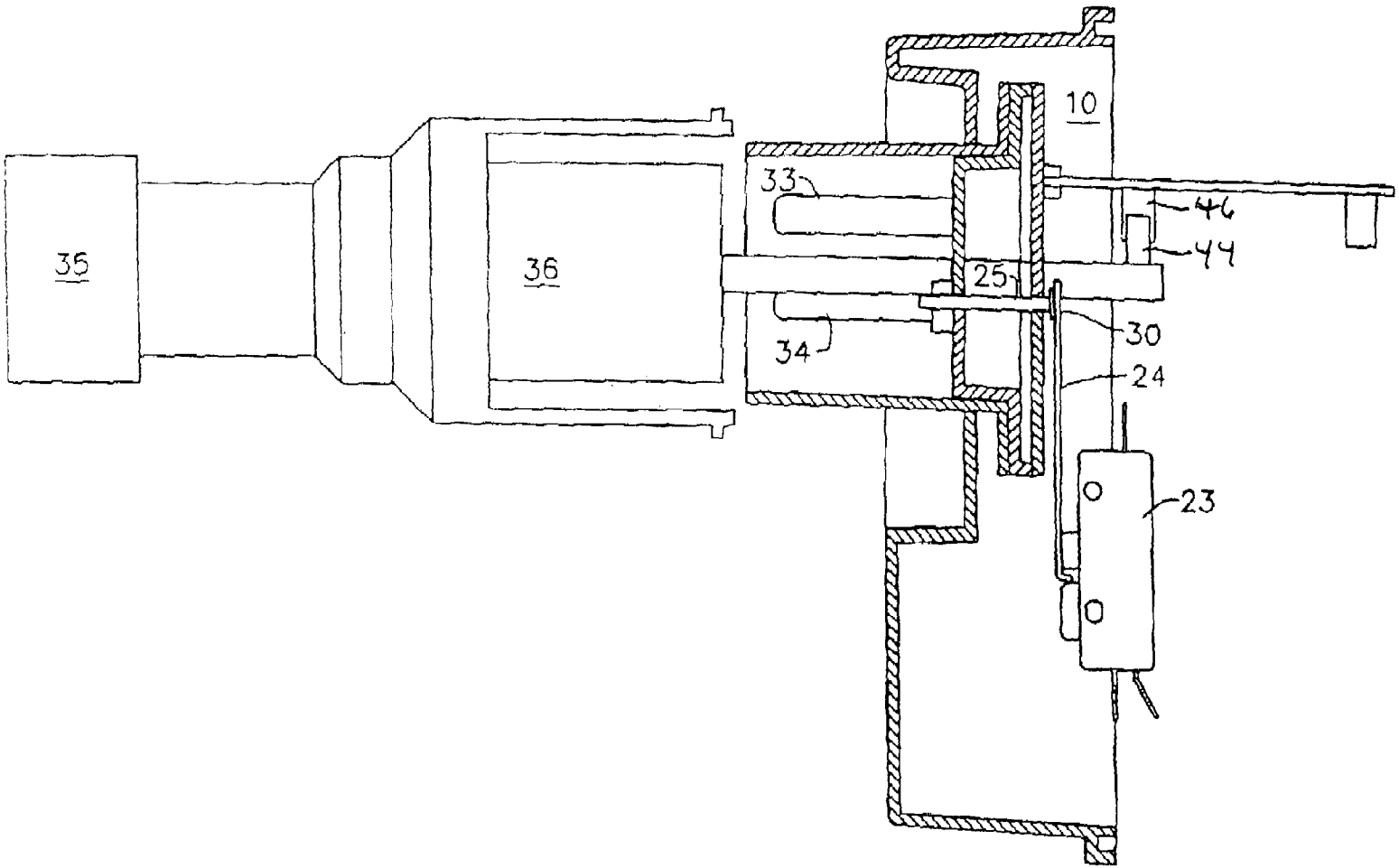
FIG. 6 is the partial assembly drawing shown in FIG. 5 illustrating features of the invention in a different mode of operation.

Turning now to FIG. 6, the plug 35 and its mating portion 36 have been disconnected from the three contacts of which only the contacts 33, 34 are shown in FIG. 6 of the drawing. Of particular importance, the significance of which will be explained later, the sensor pin 25 continues to be pressed against the free end 30 of the microswitch arm 24 although the sensor pin 25 no longer presses against the mating portion 36 of the plug 35 thereby enabling the microswitch 23 to disconnect the power line from the automatic disconnect apparatus 10. Note in this respect that the sensor pin 25 has a substantially shorter stroke, or length, than the corresponding male contacts 33, 34. As a consequence, the microswitch 23 is activated to uncouple the power line from the disconnect apparatus 10 before the male contacts 33, 34 are fully disconnected from their counterpart female contacts (not shown) in the mating portion 36 of the plug 35. In this way, undesirable arcing between the male and female contacts is largely eliminated.

Figure 7:
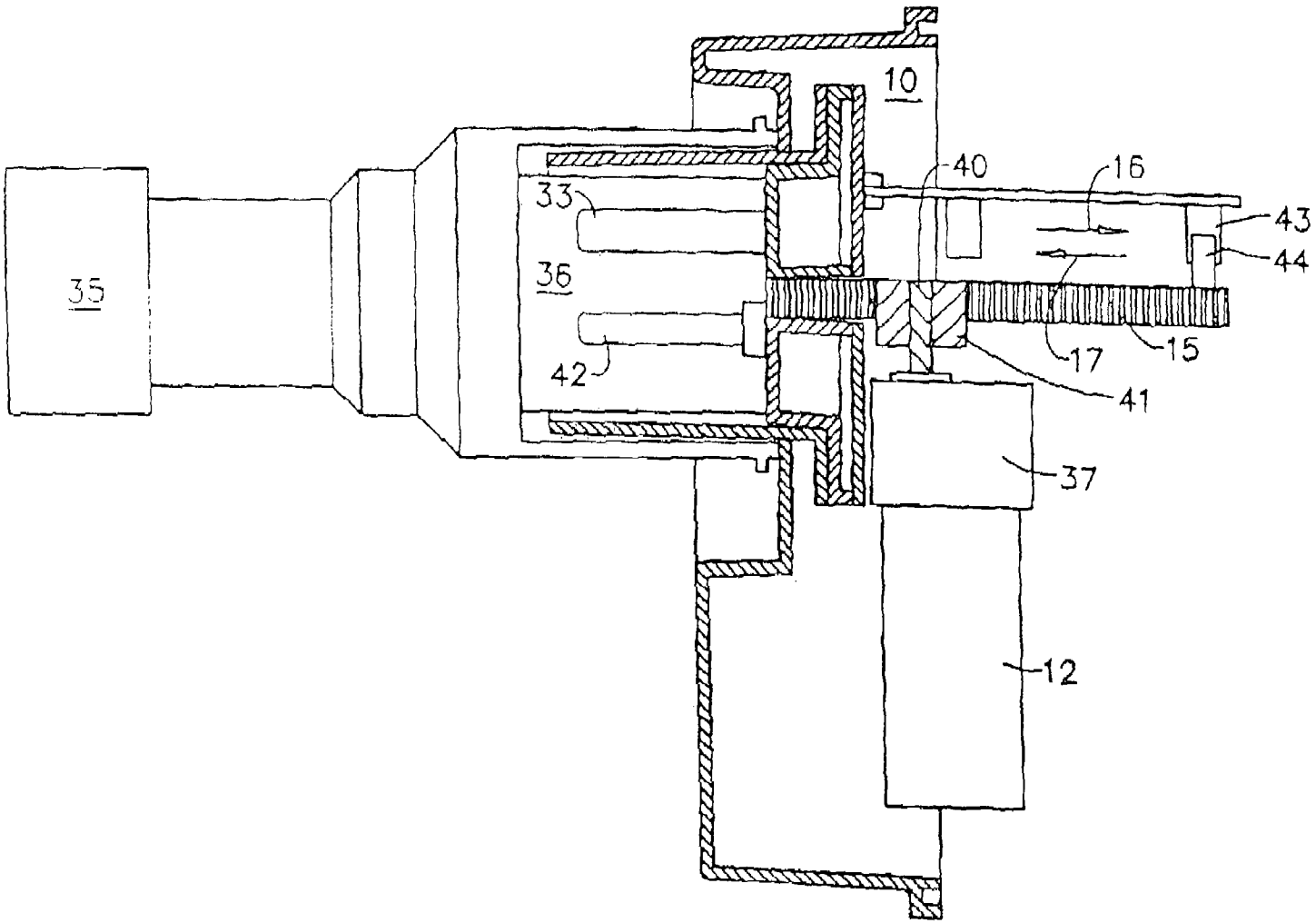
FIG. 7 is the other side of the partial assembly drawing shown in FIG. 5 illustrating additional features of the invention in the mode of operation shown in FIG. 5.

Attention now is invited to FIG. 7 which illustrates the motor 12 in relation to other structural features of the disconnect apparatus 10. The motor 12, mounted on the motor bracket 14 (not shown in FIG. 7) has a gearhead 37 with a protruding shaft 40 that is secured to a pinion gear 41. As shown, the gearhead 37 matches the speed of the rotor (not shown) of the motor 12 to the desired rotational speed of the pinion gear 41. The gear rack 15 meshes with the pinion gear 41 in order to move the gear rack 15 selectively in the directions of the arrows 16, 17. The configuration for the structure shown in FIG. 7 illustrates the automatic disconnect apparatus 10 in its usual operating position. Thus, with the three male electrical contacts, of which only the contact 33 and contact 42 are shown in FIG. 7, fully seated within corresponding female contacts in the mating portion 36 of the plug 35, the gear rack 15 is fully retracted in the direction of the arrow 16.

In a manner described subsequently in more complete detail, the activation of the microswitch 23 to apply power to the disconnect apparatus 10 also has an effect on the motor 12 (FIG. 7). The motor 12 is energized to rotate the pinion gear 41 to drive the gear rack 15 in the direction of the arrow 16. To limit the movement of the gear rack 15 in the direction of the arrow 16, a photoelectric detector 43 responds to the presence of a flag 44 that protrudes from the side of gear rack 15 over the photosensitive portion of the detector 43. When the flag 44 on the gear rack 15 interrupts the light stimulation for the photoelectric detector, the photoelectric detector 43 stops the motor 12. Consequently, with the motor 12 stopped, the movement of the gear rack 15 in the direction of the arrow 16 also is stopped.

Figure 8:
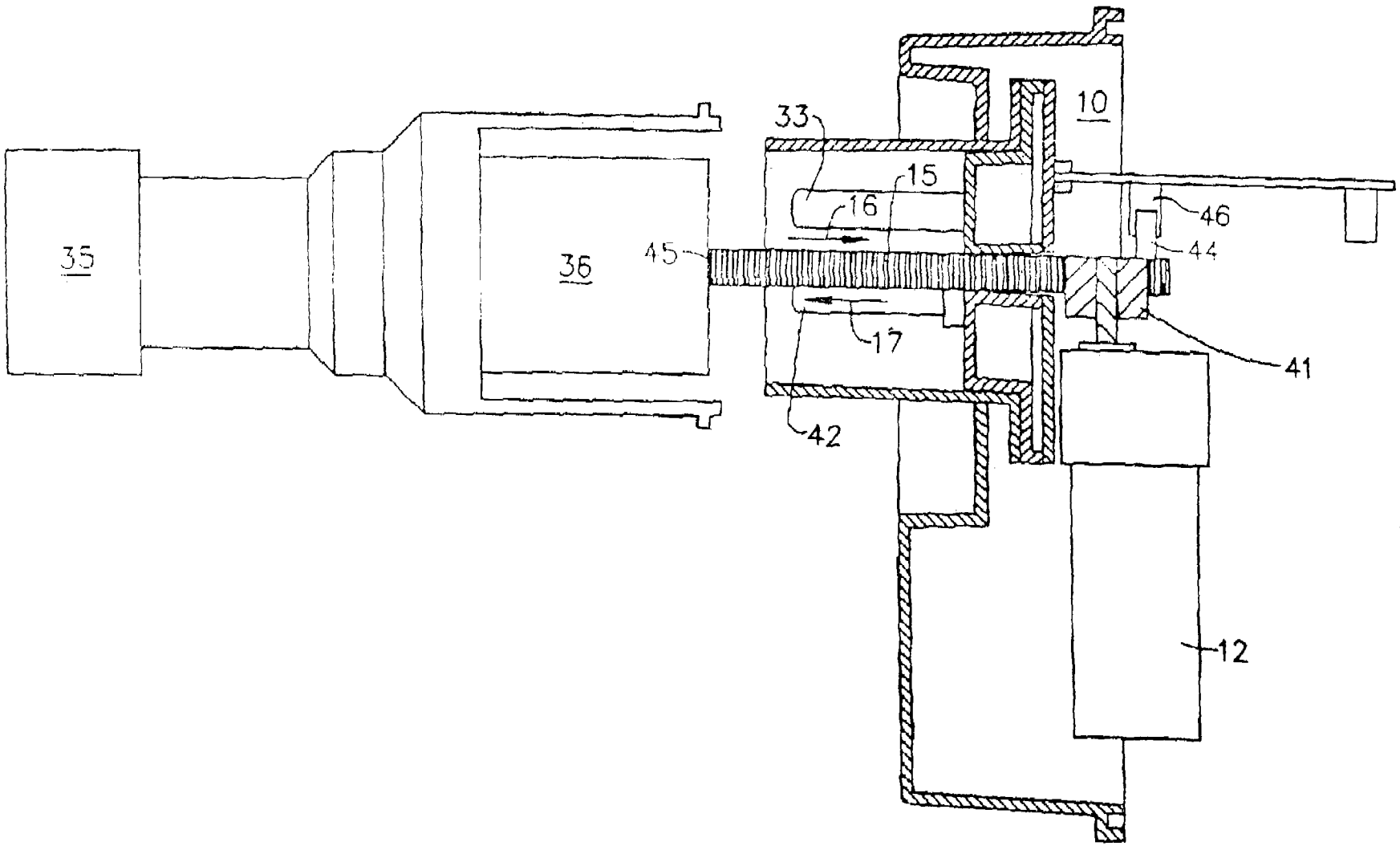
FIG. 8 is the other side of the partial assembly drawing shown in FIG. 6 also illustrating additional features of the invention in a different mode of operation.

Turning now to FIG. 8, it will be noted that the gear rack 15 is fully extended in the direction of the arrow 17. It is, in this mode of operation that end 45 of the gear rack 15 presses the mating portion 36 of the plug 35 in the direction of the arrow 17. The rotation of the motor 12 and the pinion gear 41 thus drive the gear rack 15 in the direction of the arrow 17 until:

1. The sensor pin 25 (FIG. 6) has first activated the microswitch 23 to disconnect the power line from the disconnect apparatus 10 before the three male contacts 33, 34 and 42 (FIG. 8) are fully disengaged from their respective female counterpart contacts in the mating portion 36 of the plug 35;
2. The plug 35 is completely ejected from its position enclosing the cone 32;
3. All three of the male contacts (of which only contacts 33 and 42 are shown in FIG. 8) are disconnected from their respective female counterpart connectors in the mating portion 36 of the plug 35; and
4. The flag 44 (FIG. 8) on the gear rack 15 interrupts photoelectric stimulation of photoelectric detector 46 to first stop the motion of the gear rack 15 in the direction of the arrow 17, to reverse the direction of the motor 12 to drive the gear rack 15 back in the direction of the arrow 16, retracting the gear rack 15 while the microswitch 23 (FIG. 6) remains deactivated because the sensor pin 25 is not pressing against the mating portion 36 of the plug 35.

All of these automatic steps are initiated, moreover, through the activation of the vehicle's or vessel's engine. For example, on energizing the starter in a vehicle, the starter sends a signal through the circuit shown in FIGS. 1 and 2 to energize the ejection drive electric motor 12.

For instance, the motor 12 (FIG. 4) is controlled by a run and dynamic brake relay 47 (FIG. 2) which, when energized, causes the motor 12 to run. When deenergized, however, the motor terminals are short-circuited to dynamically brake the motor. A motor reversing relay 50 acts, when energized, to extend the gear rack 15 as shown in FIG. 8. These relays 47, 50 are activated through NPN transistors 51, 52, respectively, so that each of the relays 47, 50 receives its respective activating input signal from its individual time circuit, a run timer 53 (FIG. 1) and a reverse timer 54.

The run timer 53 responds to a signal from vehicle starter 55 through a path that includes a zener diode 56, NPN transistor 57 and a terminal 60 on the run timer 53. The run timer 53 in turn, through the NPN transistor 51 (FIG. 2), activates the run and dynamic brake relay 47. The zener diode 56, moreover, provides a low voltage lock out for the system. Illustratively, the zener diode 56 will prevent the system from operating if the input voltage from the starter 55 is below an illustrative 7 volts, for example.

Turning once more to the motor reversing relay 50 (FIG. 2), when the gear rack 15 (FIG. 8) reaches the limit of its extension, a circuit interrupter 61 (FIG. 1) sends a signal to a terminal 62 at the reverse timer 54. The signal from the reverse timer 54 then enables the NPN transistor 52 (FIG. 2)

which energizes the motor reversing relay 50. As a consequence, the motor 12 (FIG. 8) reverses, driving the gear rack 15 in the direction of the arrow 16 to retract the gear rack 15. Once the gear rack 15 is fully retracted, another circuit interrupter 63 (FIG. 1) is activated to send signals to reset terminals 64, 65 on the timers 53, 54, respectively, thus resetting both of the timers 53, 54. Once the timers 53, 54 are reset, the timer 53 sends a signal to the NPN transistor 51 (FIG. 2) to enable the transistor and thereby activate the run and dynamic brake relay 47 to dynamically brake and stop the motor 12.

The timers 53, 54 (FIG. 1) do not run for their respective entire timing cycles, the run time being determined by the time required for the motor 12 (FIGS. 7 and 8) to fully extend and retract the gear rack 15. The run timer 53 (FIG. 1) limits the length of time the motor 12 (FIGS. 7 and 8) will be energized.

Should power be applied with the gear rack 15 in a position between the two extremes of its travel, a capacitor 66 (FIG. 1), the startup synchronizing capacitor, will send a signal through a conductor 67 to the reset terminal 64 on the run timer 53 to extend the gear rack 15, allowing the system to complete its cycle and shut down.

A further NPN transistor 70 responds to a signal from the reverse timer 54, when the reverse timer 54 is running, through a conductor 71 to ground out an input signal from the starter 55 and thus lock out the starter 55 and prevent the starter input from initiating a normal eject cycle while the reverse timer 54 is retracting the gear rack 15.

In operation, and as best shown in FIG. 5, the three male contacts 33, 34 in the cone 32 are fully seated in electrical contact with corresponding female contacts in the mating portion 36 of the plug 35. The sensor pin 25, in contact with the mating portion 36, is pressed back in the direction of the arrow 27. The sensor pin 25 presses the free end 30 of the microswitch arm 24, thereby activating the microswitch 23 to apply line power through the plug 35 and the automatic disconnect apparatus 10 to the vehicle or vessel (not shown).

On starting the engine of the vehicle or vessel, the starter 55 (FIGS. 1 and 2) is energized sending a signal through zener diode 56 and the NPN transistor 57 to enable the NPN transistor 51 via the run timer circuit 53. So enabled, the NPN transistor 51 activates the run and dynamic brake relay to start the motor 12 (FIG. 7). As the plug 35 is being separated from the male electrical contacts 33, 34 and 42 in the cone 32 (FIG. 5), the sensor pin 25 is pressing on the surface of the mating portion 36 of the plug 35, moves in the direction of the arrow 26. This motion releases the microswitch 23 before the male contacts 33, 34 and 42 in the cone 32 lose electrical contact with the female contacts in the plug 35. The microswitch 23 then acts to shut down the power from the power main to the vehicle through the automatic disconnect apparatus 10 before electrical contact between the male and female contacts is broken. In this manner, the damaging arcing that has characterized many prior art devices is generally avoided in spite of high current loads passing through the apparatus 10.

Figure 1:
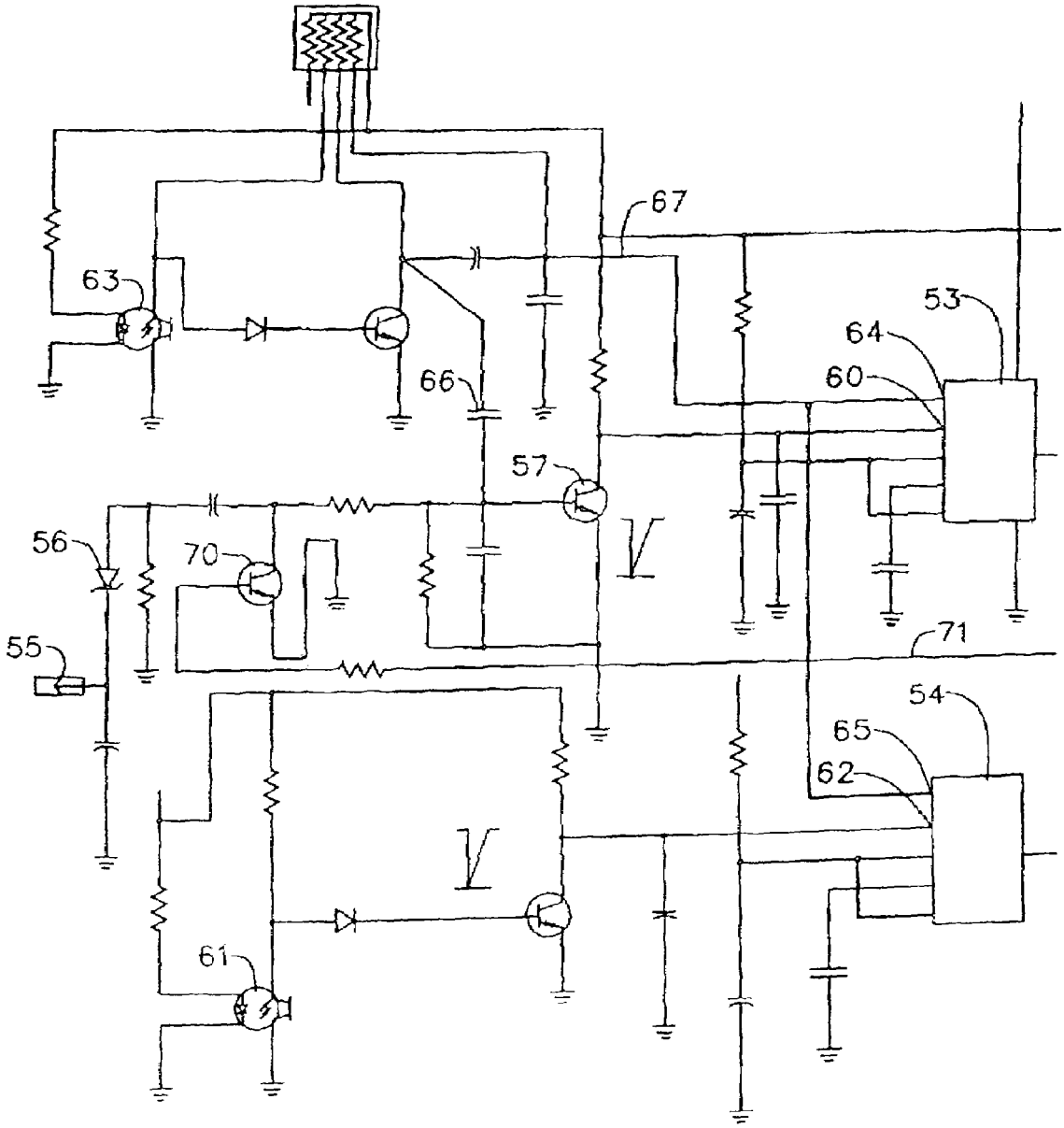
FIG. 1 is a portion of a typical electrical circuit for use in connection with the invention.
Figure 2:
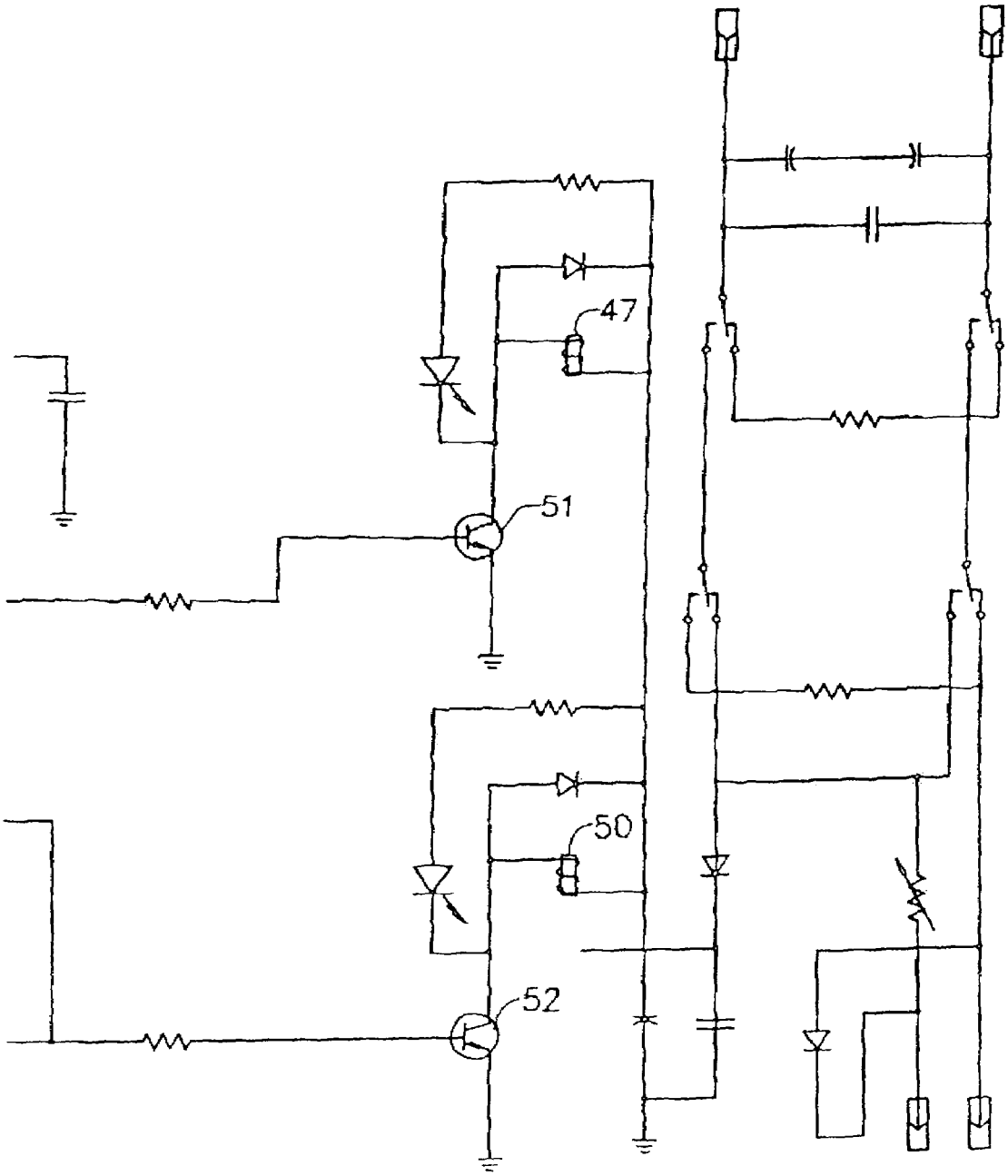
FIG. 2 is the balance of the electrical circuit shown in FIG. 1.
Figure 3:
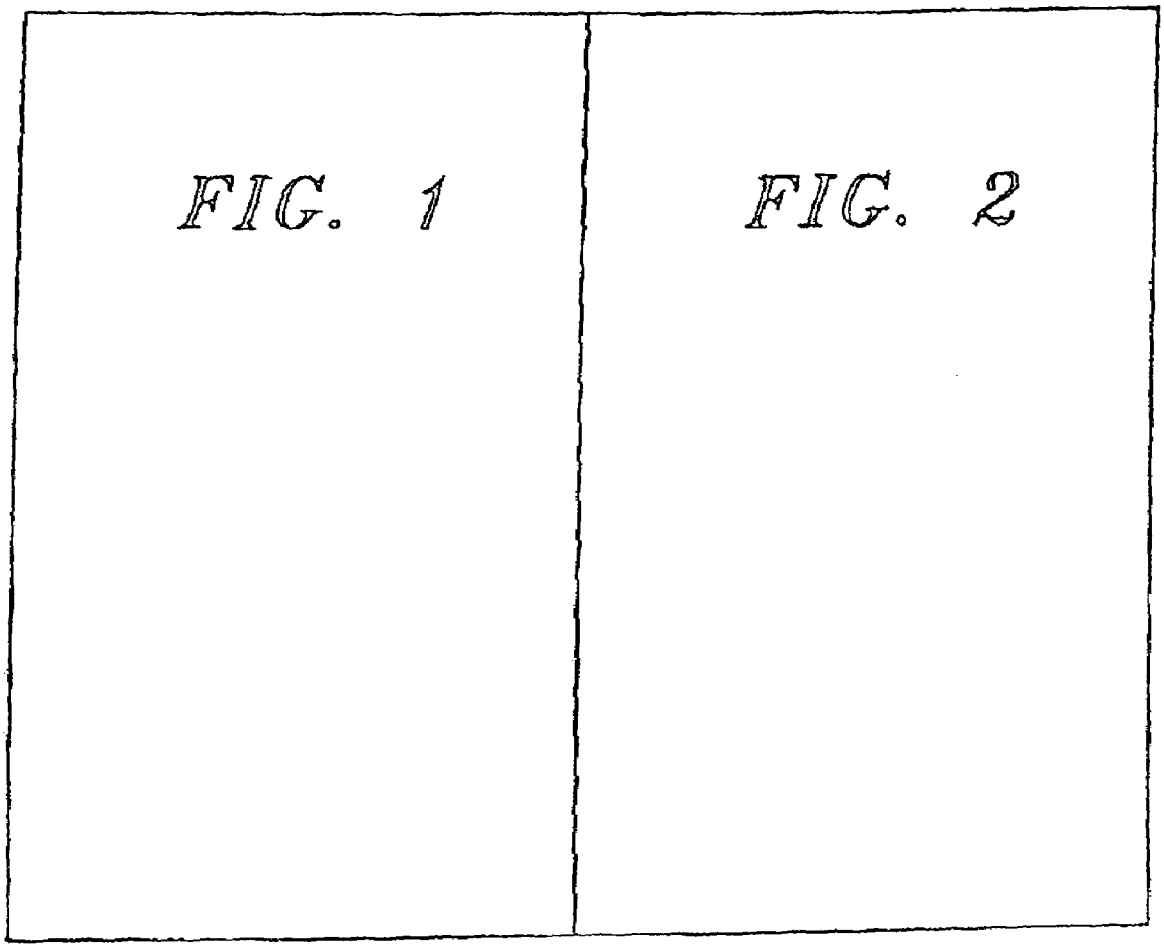
FIG. 3 is a diagram showing the arrangement of FIGS. 1 and 2 to illustrate the entire electrical circuit.

At the same time as the sensor pin 25 and the microswitch are acting to discontinue the flow of electrical power through the automatic disconnect apparatus 10, the signal from the starter 55 (FIGS. 1 and 2) also energizes the motor 12 (FIG. 7) by activating the run and dynamic brake relay 47 (FIGS. 1 and 2). So activated, the pinion gear 41, driven by the motor 12, forces the gear rack 15 in the direction of the arrow 17 until a condition is reached as shown in FIG. 8 in which the plug 35 is completely separated from the cone and its associated electrical contacts.

In this circumstance, the photoelectric cell 46 activates the current interrupt 61 (FIGS. 1 and 2). A signal then is sent through the reverse timer 54 which activates the reverse relay 50. On activation, the reverse relay 50 causes the motor 12 (FIG. 8) to reverse itself and retract the gear rack 15 as shown in FIG. 7.

When the gear track 15 is fully retracted, the photoelectric detector 43 activates the circuit interrupter 63 (FIGS. 1 and 2) which, in the manner previously described, causes the run and dynamic brake relay 47 to shut down the motor 12 and deenergize the circuit.

Thus, there is described an embodiment of an improved apparatus for automatically disconnecting vehicles and the like from power supplies, especially with respect to high amperage currents. This improved apparatus further avoids the electrical contact degradation caused by arcing which characterized many prior art devices.

Changes, substitutions and other diversions are foreseeable without departing from a main theme of invention defined in claims which follow. For example, as noted hereinbefore, a direct current motor is preferred as a driver. Yet an alternating current motor, or a hydraulic system, or a pneumatic system, could be used as the driver without departing from the main theme of invention.

What is claimed is:

1. An automatic power line disconnect apparatus for response to a disconnect signal comprising a receptacle for the apparatus, a male electrical contact having a length protruding from said receptacle, a switch, a sensor pin protruding from said receptacle for movement through a predetermined distance relative to said male electrical contact, a plug for uncoupling and coupling to said receptacle, a mating plug portion for contact with said sensor pin for selectively moving said pin through said predetermined distance, a driving means responsive to the disconnect signal for moving said mating plug portion and said sensor pin through said predetermined distance, said predetermined distance being less than said protruding male electrical contact length for selectively deactivating said switch and disconnecting the power line disconnect apparatus from the power line.

2. An automatic power line disconnect apparatus according to claim 1 further comprising, a female electrical contact for said plug to establish electrical continuity through said male electrical contact with the power line in said coupled state.

3. An automatic power line disconnect apparatus for uncoupling a plug to the power line in response to an engine activation signal, comprising a direct current motor, a pinion gear selectively rotatable by said motor, a gear rack meshed with said pinion gear for linear movement in response to said pinion gear rotation, and a circuit for energizing said direct current motor in response to the engine activation signal, said energized motor rotation in a first direction to press said gear rack against the plug to uncouple the plug from the power line disconnect apparatus.

4. An automatic power line disconnect apparatus according to claim 3 further comprising a photoelectric detector for sensing said gear rack motion, and a circuit responsive to said photoelectric detector for energizing said direct current motor for rotation in a direction opposite. to said first direction to retract said gear rack toward the automatic power line disconnect apparatus.

5. An automatic power line disconnect apparatus according to claim 4 further comprising another photoelectric detector for sensing said gear rack in said retracted status, and a circuit responsive to said another photoelectric detector to dynamically brake said direct current motor and terminate said gear rack movement.

6. An automatic power line disconnect apparatus according to claim 5 further comprising a low voltage lock out circuit for the engine activation signal to prevent the disconnect apparatus from operating.

7. An automatic power line disconnect apparatus according to claim 6 further comprising a timer circuit for limiting the length of time said direct current motor is energized.

8. An automatic power line disconnect apparatus according to claim 7 further comprising a startup synchronizing capacitor for resetting said timer circuit to enable the disconnect apparatus to shut down.

9. An automatic power line disconneict apparatus according to claim 8 further comprising a. circuit coupled to said timer circuit to lock out the engine activation signal and to prevent the engine activation signal from disconnecting the power line from uncoupling the plug during power line disconnect apparatus activation.

* * * * *